US008115415B2

(12) United States Patent
Moon et al.

(10) Patent No.: US 8,115,415 B2
(45) Date of Patent: Feb. 14, 2012

(54) BACKLIGHT UNIT, DISPLAY DEVICE COMPRISING THE SAME, AND CONTROL METHOD THEREOF

(75) Inventors: Seung-hwan Moon, Yongin-si (KR); Ki-chan Lee, Cheonan-si (KR); Kyung-uk Choi, Asan-si (KR); Sang-gil Lee, Seoul (KR); Yun-jae Park, Yongin-si (KR); Hyun-suk Ko, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 663 days.

(21) Appl. No.: 12/251,811

(22) Filed: Oct. 15, 2008

(65) Prior Publication Data

US 2009/0134814 A1 May 28, 2009

(30) Foreign Application Priority Data

Nov. 26, 2007 (KR) ..... 10-2007-0121051

(51) Int. Cl.
*G05F 1/00* (2006.01)

(52) U.S. Cl. ..... 315/307; 315/169.4; 315/294; 315/360; 345/82; 345/102; 345/204

(58) Field of Classification Search ..... 345/82, 345/102, 204; 315/169.4, 291, 294, 307, 315/360

See application file for complete search history.

(56) References Cited

U.S. PATENT DOCUMENTS 5,657,040 A * 8/1997 Kanbara ..... 345/98
5,973,661 A * 10/1999 Kobayashi et al. ..... 345/100
6,392,629 B1 * 5/2002 Murakami et al. ..... 345/98
7,443,376 B2 * 10/2008 Suzuki ..... 345/100
7,495,397 B2 * 2/2009 Okabe ..... 315/169.1

* cited by examiner

*Primary Examiner* — Jason M Crawford
(74) *Attorney, Agent, or Firm* — F. Chau & Associates, LLC

(57) ABSTRACT

A backlight unit includes a plurality of light source units arranged in a matrix form, a light source controller outputting a dimming signal to control a brightness of the light source units and a latch signal to control a light source unit row of the plurality of light source units to be sequentially driven according to a predetermined scanning period, and a plurality of light source driving units connected to light source unit columns of the plurality of light source units and supplying driving signals corresponding to the dimming signal to the light source units in the light source unit columns.

20 Claims, 6 Drawing Sheets

BACKLIGHT UNIT, DISPLAY DEVICE COMPRISING THE SAME, AND CONTROL METHOD THEREOF

CROSS-REFERENCE TO RELATED APPLICATION

This application is based on and claims priority from Korean Patent Application No. 10-2007-0121051, filed on Nov. 26, 2007, the disclosure of which is incorporated by reference herein.

BACKGROUND OF THE INVENTION

1. Technical Field

The present invention relates to a backlight unit, a display device comprising the same, and a control method thereof.

2. Discussion of the Related Art

A flat panel display device, such as a liquid crystal display (LCD), a plasma display panel (PDP), and an organic light emitting device (OLED), is being developed to replace a cathode ray tube (CRT).

The LCD may include a liquid crystal panel having a lower substrate having thin film transistors, an upper substrate, and a liquid crystal layer disposed between the substrates. Since the LCD does not emit light by itself, a backlight unit is provided behind the lower substrate to provide light.

To enable a user to selectively control the light of the backlight unit as necessary, the backlight unit includes light emitting diodes as a point light source. Referring to a unit of point light source supplied with a driving voltage as a channel and a driving unit to drive a plurality of channels as a driving module, a previously-proposed driving module includes eight channels and one driving unit to drive the eight channels. When a single set of eight channels is arranged along the width direction of the liquid crystal panel and driven, a driving module for the eight channels may not be suitable for the liquid crystal panels with various sizes. For Example, when the liquid crystal panel is enlarged in the width direction, the number of channels is increased in the width direction. However, as a previously-proposed driving module is a module for eight-multiple channels, more or fewer channels are provided for the module, resulting in an increase of the manufacturing cost of the backlight unit.

SUMMARY OF INVENTION

A backlight unit according to an exemplary embodiment of the present invention includes a plurality of light source units arranged in a matrix form, a light source controller for outputting a dimming signal to control a brightness of the light source units and a latch signal to control a light source unit row of the plurality of light source units to be sequentially driven according to a predetermined scanning period, and a plurality of light source driving units connected to light source unit columns of the plurality of light source units for supplying driving signals corresponding to the dimming signal to light source units in the respective light source unit columns.

According to an exemplary embodiment of the present invention, each of the light source driving unit may include a unit selection part, a plurality of sample and hold units connected to the unit selection part to store dimming data corresponding to the dimming signal, a plurality of pulse-width-modulation (PWM) controllers connected to the sample and hold units to output the driving signals corresponding to the dimming data to the light source units, and a shift register outputting a carry signal to an adjacent light source driving unit when the dimming data is stored in the corresponding sample and hold units. The unit selection part may enable one of the sample and hold units and the enabled sample and hold unit may store the dimming data. According to an exemplary embodiment of the present invention, the unit selection part may sequentially enable the plurality of sample and hold units based on an inputted carry signal.

According to an exemplary embodiment of the present invention, the light source controller further outputs a horizontal synchronization start signal, and the unit selection part may enable one of the sample and hold units based on the horizontal synchronization start signal.

According to an exemplary embodiment of the present invention, when the light source unit column may include N-number light source units, the dimming data may be stored for 1/N of the scanning period in the light source unit row, and the stored dimming data may be output to the PWM controllers in synchronization with the latch signal.

According to an exemplary embodiment of the present invention, each of the PWM controllers may output the driving signal based on the dimming data to the corresponding light source unit for the scanning period.

According to an exemplary embodiment of the present invention, each of the PWM controllers may output the driving signal corresponding to the dimming data to the corresponding light source unit for a turn-on period shorter than the scanning period.

According to an exemplary embodiment of the present invention, the turn-on period may be about (3/8) of the scanning period.

According to an exemplary embodiment of the present invention, each of the light source unit column may include eight light source units.

According to an exemplary embodiment of the present invention, the light source units may include a plurality of point light sources.

According to an exemplary embodiment of the present invention, a liquid crystal display includes a display panel where an image is displayed, a plurality of light source units providing light to the display panel and arranged in a matrix form; a light source controller outputting a dimming signal to control a brightness of the light source units and a latch signal to control a light source unit row of the light source units to be sequentially driven according to a predetermined scanning period, and a plurality of light source driving units sequentially supplying driving signals corresponding to the dimming signal to light source units in the light source unit row, and sequentially driving the light source unit row in synchronization with the latch signal. According to an exemplary embodiment of the present invention, a control method for a liquid crystal display which comprises a display panel where an image is displayed, a plurality of light source units providing light to the display panel and arranged in a matrix form, and a plurality of light source driving units individually connected to a plurality of light source unit columns of the plurality of light source units to supply driving signals, includes the steps of outputting a dimming signal to control brightness of the light source units and a horizontal synchronization start signal, storing the dimming data corresponding to the dimming signal for a selected one of the light source units of the light source unit column, outputting a carry signal to an adjacent light source driving unit when the dimming data is stored, outputting a latch signal to sequentially drive a light source unit row according to a predetermined scanning period, and supplying driving signals corresponding to the dimming data to the light source unit row in synchronization with the latch signal.

BRIEF DESCRIPTION OF DRAWINGS

Exemplary embodiments of the present invention will become apparent and more readily appreciated by reference to the following description taken in conjunction with the accompanying drawings, wherein.

DETAILED DESCRIPTION OF EXEMPLARY EMBODIMENTS

Figure 1:
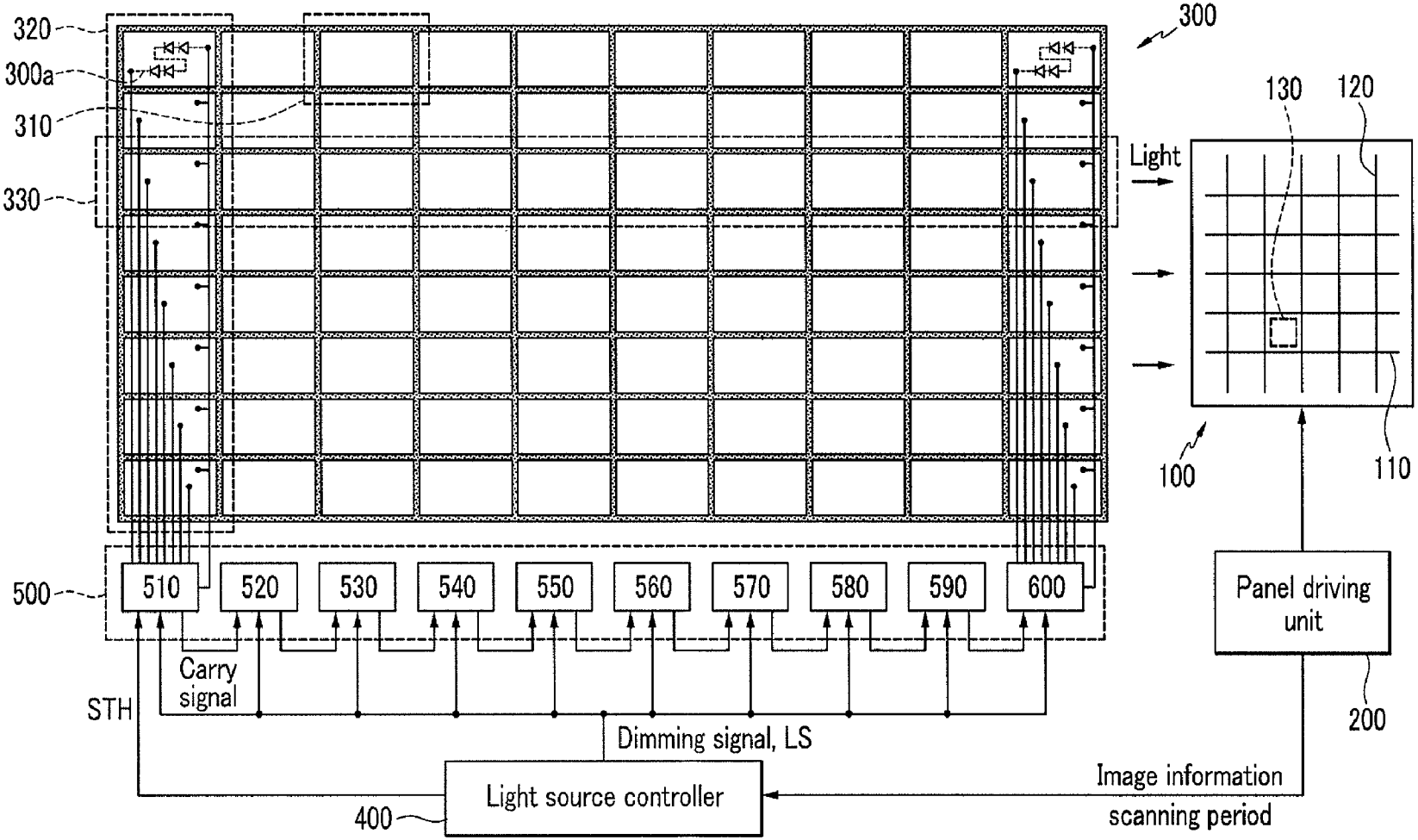
FIG. 1 is a control block diagram of a liquid crystal display according to an exemplary embodiment of the present invention.

Hereinafter, exemplary embodiments of the present invention will be described in detail with reference to the accompanying drawings, wherein like reference numerals refer to like elements throughout.

FIG. 1 is a control block diagram of a liquid crystal display according to an exemplary embodiment of the present invention.

As illustrated in FIG. 1, the liquid crystal display includes a display panel 100, a panel driving unit 200, a light source 300, a light source controller 400, and a light source driving module 500. The light source 300, the light source controller 400, and the light source driving module 500 form a backlight unit. The display panel 100 is a liquid crystal panel having a liquid crystal layer (not shown) and provided with light from the backlight unit.

The display panel 100 includes a first substrate (not shown) where thin film transistors (TFTs) are formed, a second substrate (not shown) facing the first substrate, and the liquid crystal layer (not shown) formed between the first and second substrates.

The display panel 100 is formed with a plurality of gate lines 110, a plurality of data lines 120, and a plurality of pixels 130 in a matrix form defined by the gate lines 110 and the data lines 120 and including the TFTs (not shown).

The display panel 100 has a rectangular shape of which a major side is longer than a minor side. Data signals are scanned by the frame along the length of the shorter side as a scanning direction. The display panel 100 may display images of about 60, about 120, or about 180 frames per one second. As images of more frames are displayed per one second, a scanning period (T) of a frame becomes shorter.

The panel driving unit 200 is input with various kinds of control signals and image signals from the outside and applies them to the display panel 100.

The panel driving unit 200 includes a gate driver (not shown) connected with the gate lines 110, a data driver (not shown), and a timing controller (not shown) controlling the drivers.

The panel driving unit 200 outputs image information to the light source controller 400 to control the brightness of the light source 300 corresponding to image signals. Further, a scanning period (T) where one frame is formed on the display panel 100 is provided to the light source controller 400. The light source controller 400 controls the light source driving module 500 to supply light from the light source 300 to the display panel 100 in synchronization with the display of images using the input scanning period (T).

The light source 300 includes light source units 310 arranged in a matrix form and provides light to the display panel 100.

Each of the light source units 310 is formed of a plurality of point light sources 300*a* and defined as a fundamental unit supplied with a driving voltage. That is, the point light sources 300*a* in one light source unit 310 are turned on and off simultaneously, and each light source unit 310 is supplied with a different driving voltage.

In the present embodiment, the point light sources 300*a* are provided as light emitting diodes, which are connected in series. The point light sources 300*a* are uniformly distributed throughout a point light source circuit board (not shown) disposed behind the display panel 100.

The point light sources 300*a* are formed of a unit of red, green, and blue light emitting diodes or the unit further including a white light emitting diode. Also, the point light sources 300*a* may be formed of white light emitting diodes only. The point light sources 300*a* are not limited to light emitting diodes but may include laser diodes, oxygen nanotube, etc. Alternatively, the light source 300 may include a surface light source. That is, a surface light source is divided into a plurality of parts, which are arranged in a matrix form.

In this embodiment, the light source 300 includes eight light source unit rows 330 divided in the extending direction of the gate lines 110 and ten light source unit columns 320 divided in the extending direction of the data lines 120.

One light source unit column 320 includes eight light source units 310, and one light source unit row 330 includes ten light source units 310. In other words, the light source units 310 of the present embodiment are arranged in a matrix of 8×10 throughout the light source 300.

The light source controller 400 outputs a dimming signal based on the image information and a latch signal (LS) controlling the sequential driving of the light source unit rows 330 based on the scanning period (T) to the light source driving module 500. The dimming signal is useful to control the brightness of the light source units 310. A driving voltage to be supplied to each light source unit 310 is determined based on data (referring to as "dimming data") corresponding to the dimming signal. Also, the light source controller 400 outputs a horizontal synchronization start signal STH to direct horizontal scanning of the dimming data to the light source driving module 500.

The light source driving module 500 includes the plurality of light source driving units 510 to 600 and supplies driving voltages corresponding to the dimming data to the light source units 310, respectively.

That is, when the light source controller 400 outputs the horizontal synchronization start signal STH to a first light source driving unit 510, the first light source driving unit 510 stores the dimming data according to the horizontal synchronization start signal STH, and then outputs a carry signal to a second light source driving unit 520. The second light source driving unit 520 stores the dimming data according to the carry signal input from the first light source driving unit 510. In this manner, the first to last light source driving units 510 to 600 sequentially store the dimming data.

Each light source driving unit 510-600 is connected to each of the light source unit columns 320. One light source unit column 320 and one light source driving unit 510-600 form one driving module.

In the present exemplary embodiment, an eight-channel driving module is used, and eight light source units 310 are arranged in the column direction to be matched with various sizes of a display panel. For example, when the size of the display panel 100 is increased in the major-side direction, an eight-channel driving module is added in the major-side direction to increase its size.

The first light source driving unit 510 is input with the horizontal synchronization start signal STH and a dimming signal from the light source controller 400. The first light source driving unit 510 stores the dimming data in one of a plurality of light source units 310 and transmits a carry signal to the second light source driving unit 520. In this manner, the dimming data is sequentially stored in one light source unit row 330 and is output as driving voltages by the latch signal LS output from the light source controller 400. The first light source unit row 330 to the last light source unit row 330 are input with the dimming signal while being scanned, and accordingly light is provided to the display panel 100 along with data signals being scanned.

Figure 2:
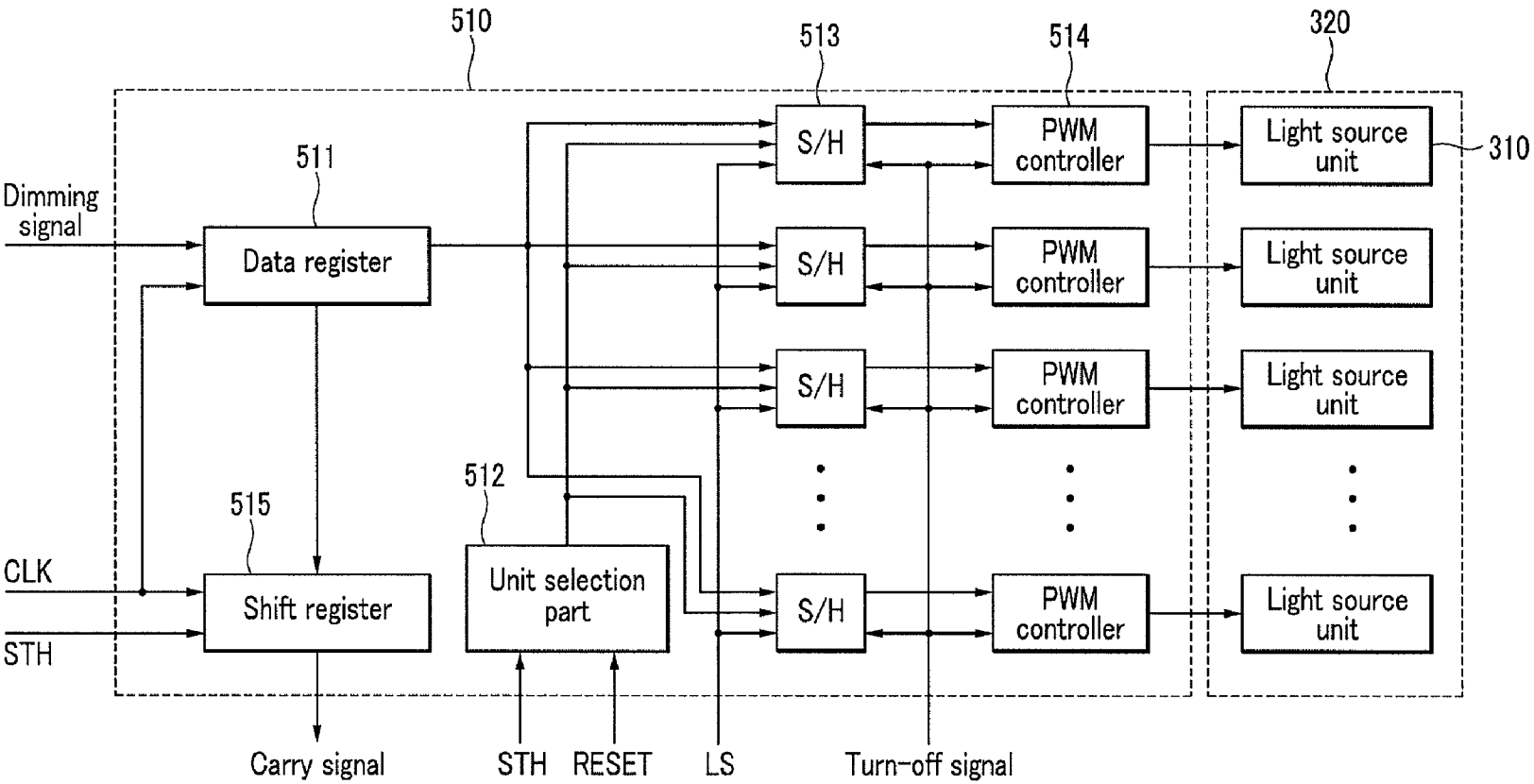
FIG. 2 is a control block diagram of a light source driving unit according to an exemplary embodiment of the present invention.

FIG. 2 is a control block diagram of the light source driving units according to the present exemplary embodiment.

The light source driving units 510 to 600 will be explained in detail with reference to the first light source driving unit 510 as an illustrative example.

As illustrated, the light source driving unit 510 includes a data register 511, a unit selection part 512, a plurality of sample and hold units (S/H) 513, a plurality of pulse-width-modulation (PWM) controllers 514, and a shift register 515. The light source driving unit 510 is connected with eight light source units 310 in the same light source unit column 320.

The data register 511 stores dimming data corresponding to a dimming signal, and the dimming data is digital signals in a predetermined bit. The dimming data input to the data register 511 is output to the sample and hold units 513.

The unit selection part 512 selects one of the light source units 310 to sequentially drive the light source units 310 in one light source unit column 320. For this, the unit selection part 512 sequentially enables the sample and hold units 513 individually connected to the light source units 310. The dimming data may be stored only in the sample and hold units 513 which have been enabled by the unit selection part 512. In other words, when the horizontal synchronization start signal STH is initially input, the sample and hold unit 513 connected with the first light source driving unit 310 is enabled. The sample and hold unit 513 connected with the second light source driving unit 310 is enabled by the next horizontal synchronization start signal STH. In the same manner, the sample and hold units 513 are sequentially enabled. The unit selection part 512 may be provided as a counter which counts the inputted horizontal synchronization start signal STH. For example, when the unit selection part 512 is provided as a 3-bit counter, the counter has "000" value by a reset signal RESET, "001 value by the first horizontal synchronization start signal STH, and "010" value by the second horizontal synchronization start signal STH. In this way, the counted value increases one by one. In this embodiment, since the light source unit column 320 includes eight light source units 310, the unit selection part 512 is provided as a 3-bit counter. However, in accordance with the number of light source units included in one light source unit column 320, the number of counted bits of the unit selection part 510 may varied.

The plurality of sample and hold units 513 are connected with the unit selection part 512 and the data register 511. When the sample and hold units 513 are enabled by the unit selection part 512, i.e., selected by the unit selection part 512, the sample and hold units 513 store the dimming data inputted from the data register 511 for a predetermined period of time. As the eight light source unit rows 330 are sequentially scanned during a scanning period T for when one frame is formed, the dimming data for each light source unit 310 of one light source unit row 330 is stored for about (T/8). In the case where the light source unit column 320 includes N-number light source units 310, the dimming data for each of N-number light source units 310 is stored for about (T/N). When the latch signal LS is input, the sample and hold units 513 output the stored dimming data to the PWM controllers 514.

A plurality of PWM controllers 514 are individually connected to the sample and hold units 513 and the light source units 310, to supply a driving voltage corresponding to the dimming data to the corresponding light source unit 310. The PWM controllers 514 are provided as various known circuits.

The light source driving unit 510 may further include a power supply for outputting the driving voltage and switching elements controlled by the PWM controllers 514.

The shift register 515 generates a carry signal using a clock signal CLK and the horizontal synchronization start signal STH input from the light source controller 400 and the dimming data output from the data register 511, and outputs the carry signal to an adjacent light source driving unit 520, i.e., the second light source driving unit 520. The shift register 515 counts the number of bits of the dimming data and outputs the carry signal when the counted number of bits reaches a predetermined number.

The carry signal output from first light source driving unit 510 is input to the unit selection part 512 of the second light source driving unit 520.

FIG. 2 shows the first light source driving unit 510, and thereby, the shift register 515 of the first light source driving unit 510 is supplied with the horizontal synchronization start signal STH. However, the second to last light source driving unit 520-600 are supplied with a carry signal output from an adjacent light source driving unit, instead of the horizontal synchronization start signal STH.

The unit selection part 512 of first light source driving unit 510 counts the number of horizontal synchronization start signals, that is, the number of pulses of the horizontal synchronization start signal STH to sequentially enable the sampling hold units 513.

Figure 3:
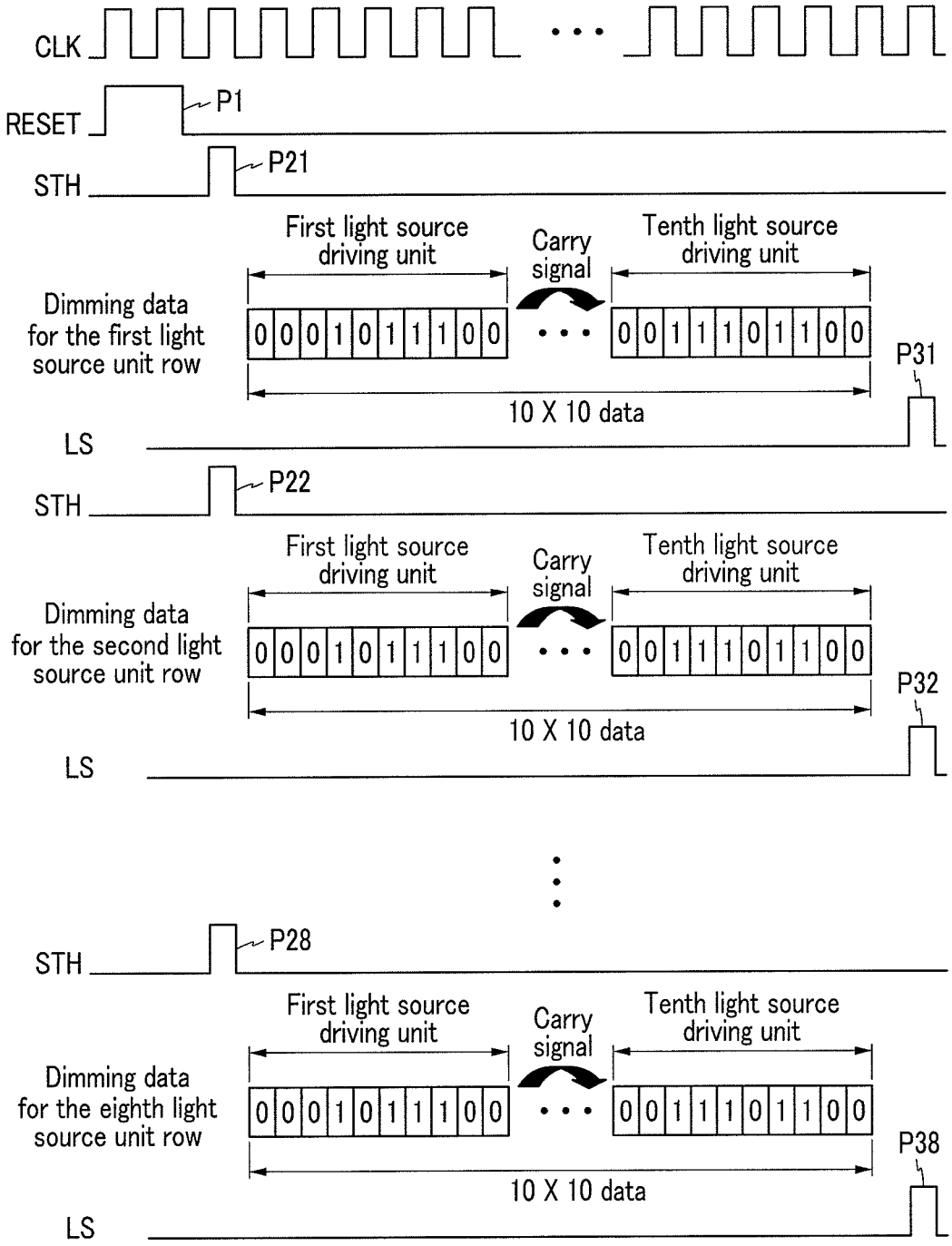
FIG. 3 is a timing diagram to illustrate data storage in light source units according to an exemplary embodiment of the present invention.

In FIG. 2, the unit selection part 512 of the first light source driving unit 510 counts the number of carry signals, but the unit selection parts 512 of the second to last light source driving units 520-600 count the number of carry signals, that is, the number of pulses of the carry signal, respectively. FIG. 3 is a timing diagram to illustrate data storage in light source units according to the present exemplary embodiment.

As illustrated, a pulse P1 of reset signal RESET is output in synchronization with a clock signal CLK. Then, when a first pulse P21 of a horizontal synchronization start signal STH is output, a dimming data is sequentially stored in the light source units 310 in the first light source unit row 330. In the present exemplary embodiment, the dimming data to drive one light source unit 310 is a 10-bit digital signal. A 10-bit dimming data is input into the first light source unit 310 in the first light source unit row 330, and then a 10-bit dimming data is input into the second light source unit 310 of the first light source unit row 330 by a carry signal. In this way, when a 10-bit dimming data is input to the last light source unit 310 so that a total 100-bit dimming data is input, the dimming data is output by a first pulse P31 of a latch signal LS output from the light source controller 400 to the PWM controllers 514 at the same time. Driving voltages generated by the PWM controllers 514 are supplied to first light source units 310 for every light source unit column 320, that is, the first light source unit row 330, and the light source unit row 330 emits light during a scanning period (T).

Then, when a second pulse P22 of the horizontal synchronization signal STH is output, a dimming data is sequentially stored in the light source units 310 in second light source units 310 for every light source unit column 320, that is, the second light source unit row 330, and the dimming data is output by a second pulse P32 of the latch signal LS to the PWM controllers 514. Repeating these processes, eight light source unit rows 330 are sequentially driven.

Figure 4:
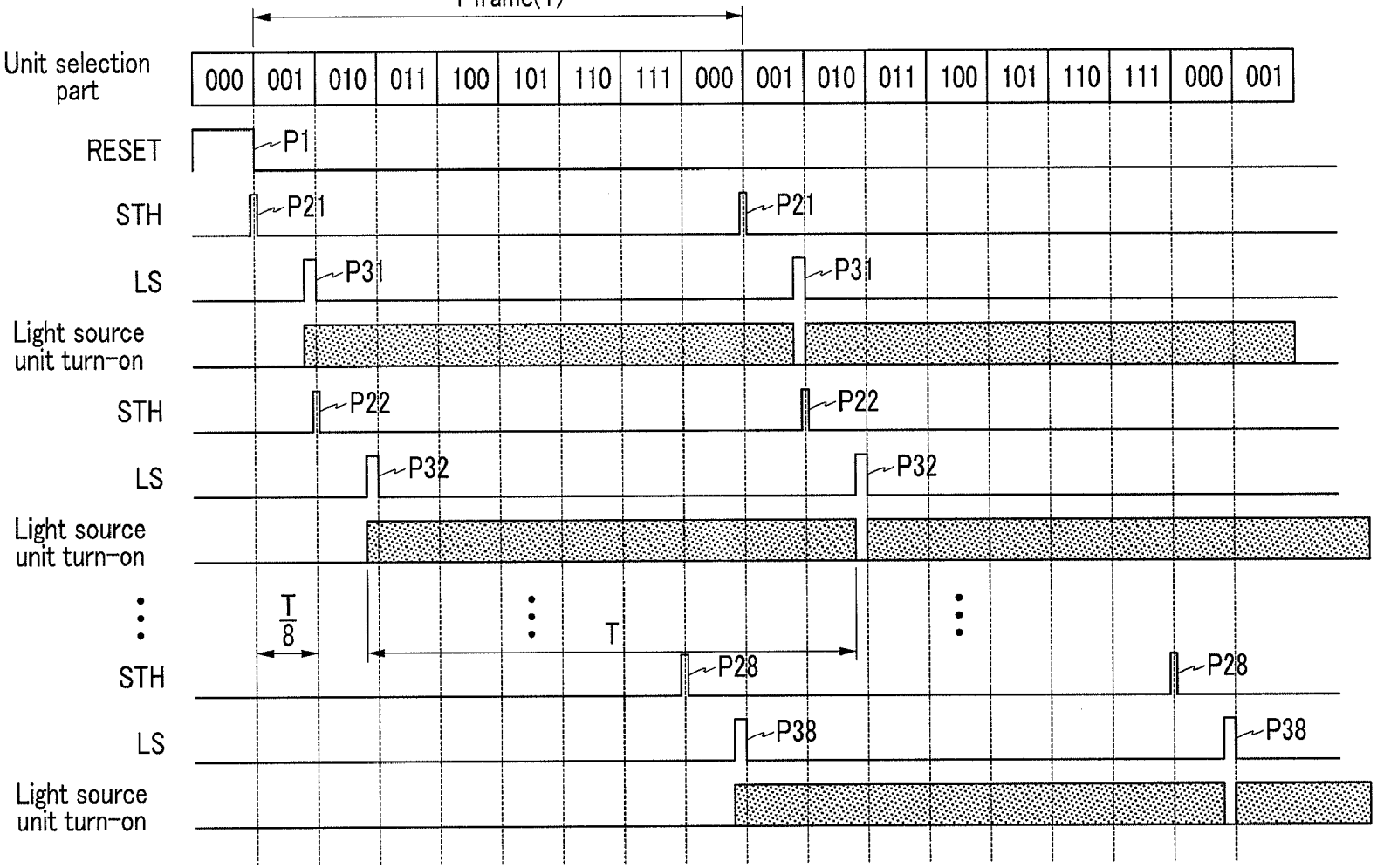
FIG. 4 is a timing diagram to illustrate the supply of driving power according to an exemplary embodiment of the present invention.

FIG. 4 is a timing diagram to illustrate the supply of driving voltages according to the present exemplary embodiment. As illustrated, when the unit selection part 512 is initialized to be a "000" value by a reset signal RESET, a horizontal synchronization start signal STH and a latch signal LS are output. A first pulse P31 of the latch signal LS and a second pulse P21 of the horizontal synchronization start signal STH are output at the same time, and a second pulse P32 of the latch signal LS and a third pulse (not shown) of the horizontal synchronization start signal STH are output at the same time. An interval of outputting the horizontal synchronization start signal STH and an interval of outputting the latch signal LS correspond to about (T/8).

The light source unit row 330 emits light during a scanning period, i.e., one frame is displayed, by input driving power and is supplied with another new driving power in synchronization with the display of next frame.

Figure 5:
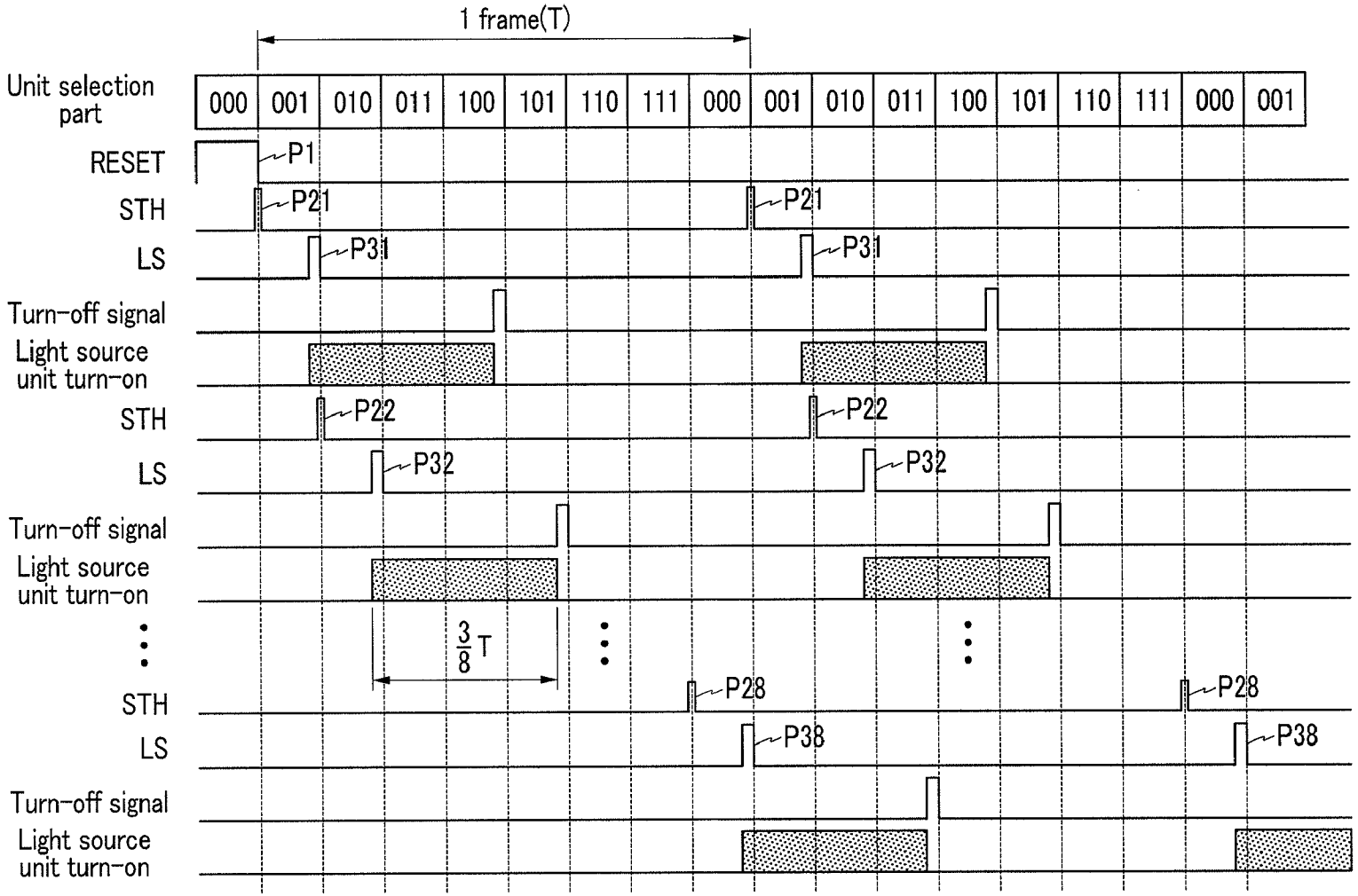
FIG. 5 is a timing diagram to illustrate the supply of driving power according to another exemplary embodiment of the present invention.

FIG. 5 is a timing diagram to illustrate the supply of driving voltages according to an exemplary embodiment of the present invention. A light source unit 310 according to the present embodiment does not emit light during a scanning period (T) but is driven during a turn-on period shorter than the scanning period (T). The process where a driving voltage is supplied to the light source unit 310 is the same as in the exemplary embodiment described in connection with FIGS. 1-4, and the description thereof will not be repeated. The previous exemplary embodiment is in a default state where a turn-off signal of FIG. 2 is not input. In the present embodiment, however, a turn-off signal to block the emission of light of the light source unit 310 is output to a sample and hold unit 514. The light source unit 310 is driven by the turn-off signal during the turn-on period shorter than the scanning period (T), and light is emitted from a light source unit row 330 during the turn-on period. As illustrated, the turn-on period in the present embodiment corresponds to about (3/8) of the scanning period (T).

In such driving method where the light source units 310 are turned off within the scanning period (T) while scanning a plurality of light source unit rows 330, light is not provided to a display panel 100 during the turn-off period, thereby giving an impulsive driving effect like a CRT. Impulsive driving prevents a blur of a moving picture on the display panel 100 and improves the quality of image signals overall. A turn-on period to improve the quality of the image signals and to prevent a blur of a moving picture is about 10% to about 50% of the scanning period, more preferably about 25% to about 35%. When the turn-on period is about (3/8) of the scanning period (T), driving efficiency is maximum. In the present embodiment, the light source units 310 are driven for about (3/8) of the scanning period (T). To achieve a turn-on time of about (3/8) of the scanning period (T) without difficulty, a standardized eight-channel driving module is now being produced.

Figure 6:
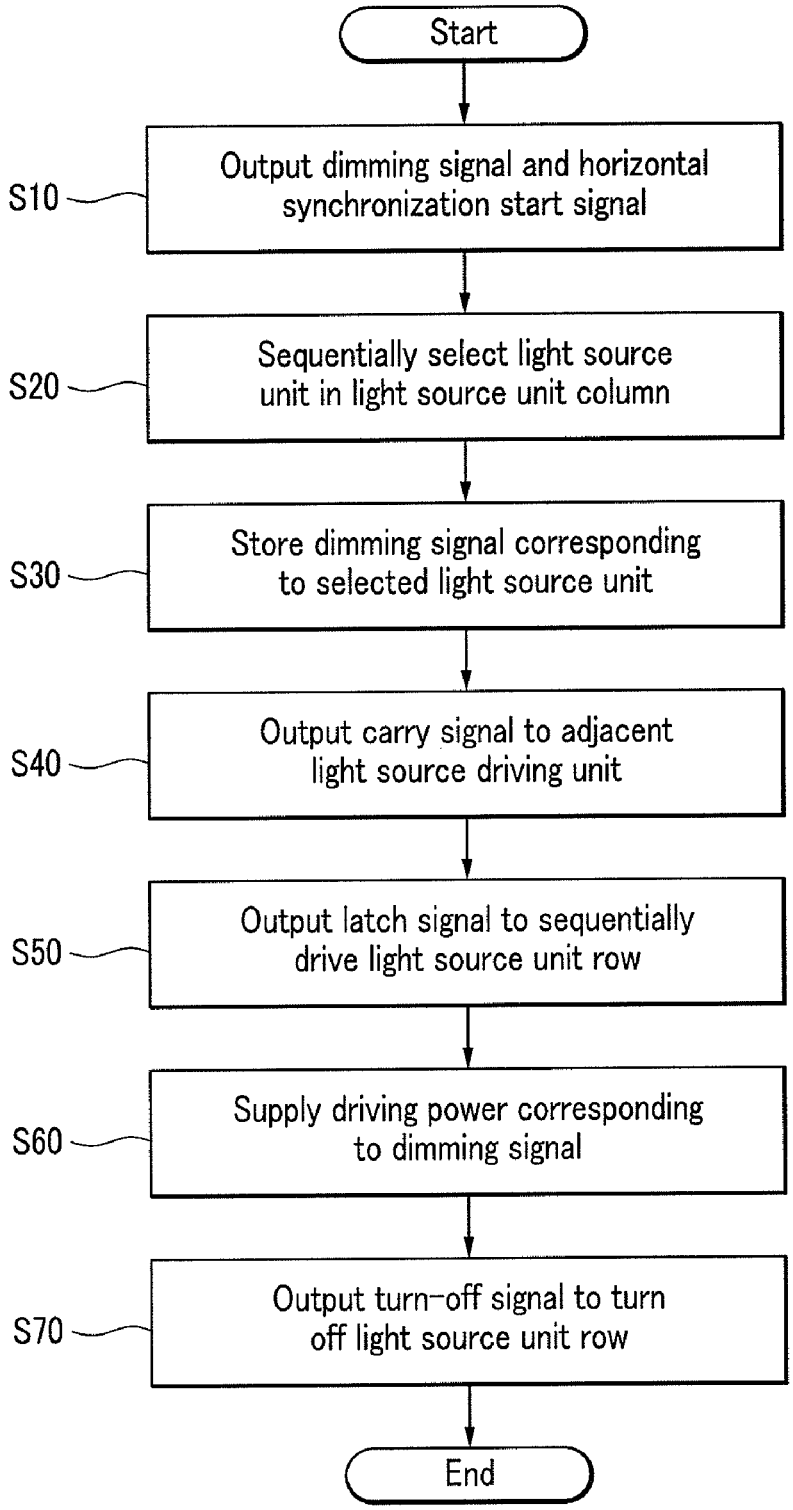
FIG. 6 is a flow chart to illustrate a control method of a liquid crystal display according to another exemplary embodiment of the present invention.

FIG. 6 is a flow chart to illustrate a control method of an LCD according to the present embodiment.

First, a light source controller 400 outputs a dimming signal to control the brightness of the light source units 310 and a horizontal synchronization start signal (STH) to a light source driving unit 510 (S10).

The light source driving unit 510 sequentially selects the light source units 310 in a light source unit column 320 (S20), and stores dimming data corresponding to a selected light source unit 310, specifically in a sample and hold unit 513 connected the light source unit 310 (S30). The light source driving unit 510 includes a unit selection part 312 provided as a 3-bit counter, and the unit selection part 312 counts the number of pulses of the horizontal synchronization start signal (STH) to sequentially select the light source units 310 along a scanning direction.

After storing the dimming data corresponding to one light source unit 310, a shift register 515 outputs a carry signal to an adjacent light source driving unit 520 (S40). The carry signal is input into a unit selection part 512 and a shift register 515 of the second light source driving unit 520. The carry signal input to the second light source driving unit 520 is a signal corresponding to the horizontal synchronization start signal (STH) input to the first light source driving unit 510.

When the dimming data is completely stored in one light source unit row 330, the light source controller 400 outputs a latch signal LS to a light source driving module 500 (S50). The latch signal LS is output in synchronization with the horizontal synchronization start signal (STH) and serves to sequentially drive the light source unit row 330.

The dimming data corresponding to the dimming signal stored in a sample hold unit 513 is output by the latch signal LS to a PWM controller 514, and the PWM controller 514 supplies a driving voltage corresponding to the dimming data to the light source unit 310 using the dimming data (S60).

Then, a turn-off signal to turn off the light source unit row 330 is output to block the emission of light of the light source unit row 330 (S70). According to the present embodiment, a turn-on period corresponds to about (3/8) of a scanning period (T). In the exemplary embodiment described in connection with FIGS. 1-4, Operation S70 is omitted.

In the foregoing description, the number of light source unit columns 320, the number of light source unit rows 330, the number of light source units 310, and the turn-on period were given only as an illustrative example, but embodiments of the present invention are not limited by the aforementioned. The elements to achieve the respective functions can be replaced with other known elements which perform the same functions.

As described above, embodiments of the present invention provide a backlight unit involving less manufacturing cost and a simple driving process, a display device comprising the same, and a control method thereof.

Further, embodiments of the present invention provide a backlight unit which is capable of being locally driven, a display device comprising the same, and a control method thereof.

Finally, embodiments of the present invention provides a backlight unit which is capable of being scanning-driven, a display device comprising the same, and a control method thereof.

Although a few exemplary embodiments of the present invention have been shown and described, it will be appreciated by those skilled in the art that changes may be made in these embodiments without departing from the principles and spirit of the disclosure.

What is claimed is:

1. A backlight unit comprising:

a plurality of light source units arranged in a matrix form;

a light source controller outputting a dimming signal to control a brightness of the light source units and a latch signal to control a light source unit row of the plurality of light source units to be sequentially driven according to a predetermined scanning period; and a plurality of light source driving units connected to light source unit columns of the plurality of light source units and supplying driving signals corresponding to the dimming signal to the light source units in the light source unit columns, wherein each light source driving unit passes a carry signal to a next light source driving unit such that each light source driving unit sequentially stores dimming data.

2. The backlight unit of claim 1, wherein each of the light source driving units comprises:

a unit selection part;

a plurality of sample and hold units connected to the unit selection part to store dimming data corresponding to the dimming signal;

a plurality of pulse-width-modulation (PWM) controllers connected to the sample and hold units to output the driving signals corresponding to the dimming data to the light source units; and a shift register outputting a carry signal to an adjacent light source driving unit when the dimming data is stored in the corresponding sample and hold unit, wherein the unit selection part enables one of the sample and hold units and the enabled sample and hold unit stores the dimming data.

3. The backlight unit of claim 2, wherein the unit selection part sequentially enables the plurality of sample and hold units based on an inputted carry signal.

4. The backlight unit of claim 3, wherein the light source controller further outputs a horizontal synchronization start signal, and the unit selection part enables one of the sample and hold units based on the horizontal synchronization start signal.

5. The backlight unit of claim 3, wherein when one light source unit column comprises N-number light source units, the dimming data is stored for 1/N of the scanning period in the light source unit row, and the stored dimming data is output to the PWM controllers in synchronization with the latch signal.

6. The backlight unit of claim 2, wherein each of the PWM controllers output the driving signal based on the dimming data to the corresponding light source unit for the scanning period.

7. The backlight unit of claim 2, wherein each of the PWM controllers outputs the driving signal corresponding to the dimming data to the corresponding light source unit for a turn-on period shorter than the scanning period.

8. The backlight unit of claim 7, wherein the turn-on period is about (3/8) of the scanning period.

9. The backlight unit of claim 1, wherein each light source unit column comprises eight light source units.

10. The backlight unit of claim 1, wherein each of the light source units comprises a plurality of point light sources.

11. A liquid crystal display comprising:

a display panel where an image is displayed;

a plurality of light source units providing light to the display panel and arranged in a matrix form;

a light source controller outputting a dimming signal to control a brightness of the light source units and a latch signal to control a light source unit row of the light source units to be sequentially driven according to a predetermined scanning period; and a plurality of light source driving units sequentially supplying driving signals corresponding to the dimming signal to light source units in the light source unit row, and sequentially driving the light source unit row in synchronization with the latch signal, wherein each light source driving unit passes a carry signal to a next light source driving unit such that each light source driving unit sequentially stores dimming data.

12. The liquid crystal display of claim 11, wherein the plurality of light source driving units are provided to individually connect to the light source unit columns, and each of the light source driving units comprises:

a unit selection part;

a plurality of sample and hold units connected to the unit selection part to store the dimming data corresponding to the dimming signal;

a plurality of pulse-width-modulation (PWM) controllers connected to the sample and hold units to output the driving voltages corresponding to the dimming data to the light source units; and a shift register outputting a carry signal to an adjacent light source driving unit when the dimming data is stored in the corresponding sample a and hold unit, wherein the unit selection part enables one of the sample and hold units and the enabled sample and hold unit stores the dimming data.

13. The liquid crystal display of claim 12, wherein when the light source unit column comprises N-number light source units, the dimming data is stored for 1/N of the scanning period in the light source unit row, and the stored dimming data is output to the PWM controllers in synchronization with the latch signal.

14. The liquid crystal display of claim 12, wherein the PWM controller outputs the driving signal based on the dimming data to the light source unit for the scanning period.

15. The liquid crystal display of claim 12, wherein the light source unit column comprises eight light source units, and the PWM controller outputs the driving voltage to the light source unit for about (3/8) of the scanning period.

16. A control method for a liquid crystal display which comprises a display panel where an image is displayed, a plurality of light source units providing light to the display panel and arranged in a matrix form, and a plurality of light source driving units connected to a plurality of light source unit columns of the light source units to supply driving signals, comprising:

outputting a dimming signal to control brightness of the light source units and a horizontal synchronization start signal;

storing dimming data corresponding to the dimming signal for a selected one of the light source units of the light source unit column;

outputting a carry signal to an adjacent light source driving unit when the dimming data is stored;

outputting a latch signal to sequentially drive a light source unit row according to a predetermined scanning period; and supplying driving signals corresponding to the dimming data to the light source unit row in synchronization with the latch signal.

17. The control method according to claim 16, wherein the step of storing the dimming signal further comprises sequentially selecting the light source units in the light source unit column.

18. The control method according to claim 16, wherein the step of supplying the driving power further comprises supplying the driving power to the light source units for the scanning period.

19. The control method according to claim 16, wherein the steps of supplying the driving power comprises supplying the driving power to the light source units for a turn-on period shorter than the scanning period.

20. The control method according to claim 19, wherein the turn-on period is ⅜ of the scanning period.

* * * * *